US005724777A

United States Patent [19]

Hubbard

[11] Patent Number: 5,724,777

[45] Date of Patent: Mar. 10, 1998

[54] ROOF DRAIN ARRANGEMENT AND METHOD

[76] Inventor: Richard M. Hubbard, 24 Park St., Haverhill, Mass. 01932

[21] Appl. No.: 559,527

[22] Filed: Nov. 17, 1995

[51] Int. Cl.[6] ..... E04B 7/18

[52] U.S. Cl. ..... 52/198; 52/199; 52/302.1; 210/163

[58] Field of Search ..... 52/198, 302.1, 52/199; 210/450, 236, 163, 164, 165

[56] References Cited

U.S. PATENT DOCUMENTS

| | | | |
|---|---|---|---|
| 2,394,964 | 2/1946 | Dick . | |
| 2,994,433 | 8/1961 | Sandin . | |
| 3,357,561 | 12/1967 | Schmid et al. . | |
| 3,884,809 | 5/1975 | Logsdon . | |
| 4,216,790 | 8/1980 | Stoltz . | |
| 4,261,824 | 4/1981 | Cuschera | 210/164 |
| 4,460,462 | 7/1984 | Arneson . | |
| 4,487,690 | 12/1984 | Logsdon . | |
| 4,652,321 | 3/1987 | Greko . | |
| 4,730,854 | 3/1988 | Cuschera | 285/42 |
| 4,739,524 | 4/1988 | Burd . | |
| 4,799,713 | 1/1989 | Uglow . | |
| 4,838,732 | 6/1989 | Clark et al. . | |
| 4,943,100 | 7/1990 | Emberson . | |
| 4,964,180 | 10/1990 | Harbeke . | |
| 4,988,234 | 1/1991 | Henkel et al. . | |
| 5,234,582 | 8/1993 | Savoie . | |
| 5,372,715 | 12/1994 | Maggard et al. | 210/164 X |
| 5,376,264 | 12/1994 | Betancourt . | |
| 5,378,356 | 1/1995 | Logsdon . | |

*Primary Examiner*—Wynn E. Wood
*Assistant Examiner*—Timothy B. Kang
*Attorney, Agent, or Firm*—Wigman, Cohen, Leitner & Myers, P.C.

[57] ABSTRACT

A roof drain arrangement and method for sealing a space between an existing drain opening, the roof drain arrangement, and a new roof membrane, is disclosed. The arrangement and method provide for sealing of an area between the roof drain arrangement and the roof structure. Sealing is provided by adhesive material disposed on a lower surface of an upper flange portion of the insert portion, or by adhesive disposed on an upper surface of a base plate, or by a roofing membrane located between the lower surface of the upper flange portion and the base plate, or by a combination thereof.

17 Claims, 2 Drawing Sheets

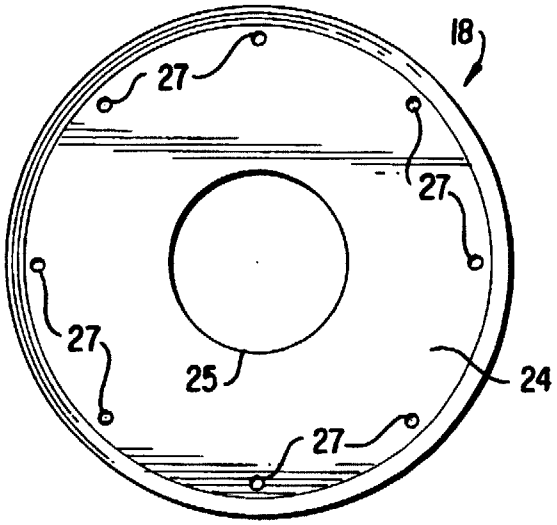
FIG. 3A
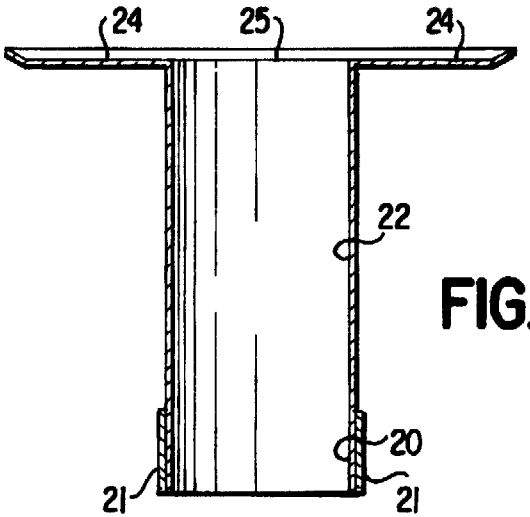
FIG. 3B
FIG. 2A
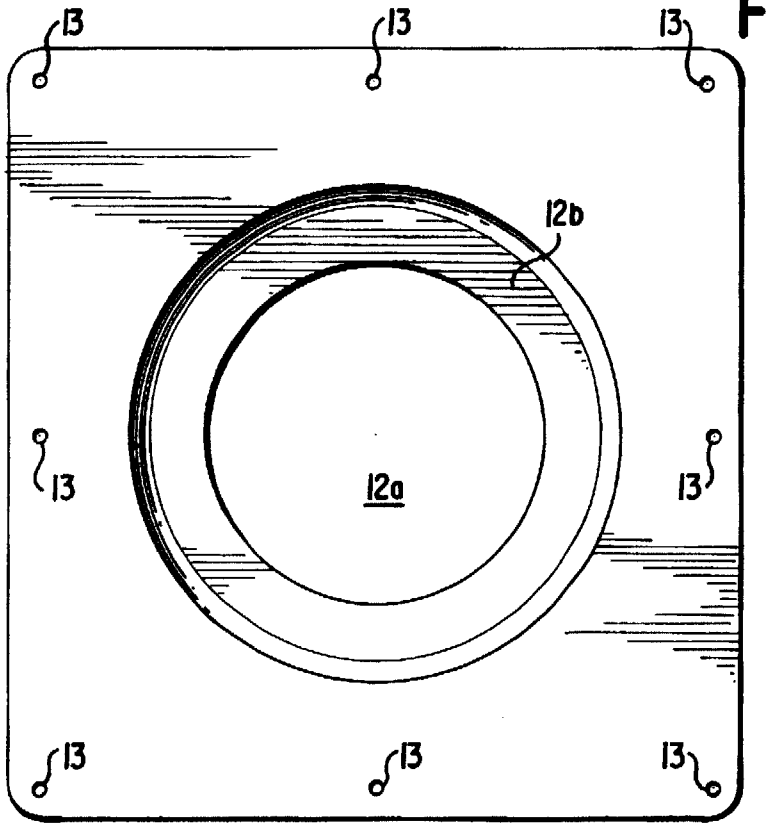
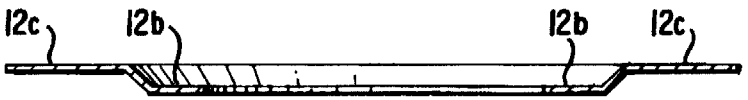
FIG. 2B

ROOF DRAIN ARRANGEMENT AND METHOD

TECHNICAL FIELD

The present invention relates to a roof drain arrangement and method, and more particularly, to a roof drain insert which can be easily retrofitted to an existing drain pipe mounted in a roof structure.

BACKGROUND OF THE INVENTION

Building structures having flat roofs are generally provided with drains. Without such drains, ponding of water can occur on the roof, and this ponding ultimately results in serious deterioration of or damage to the roof on those areas where ponding occurs. The provision of drains on such flat roofs assists in water removal during periods of rain, snow, and the like.

Roof drain arrangements of various types have been disclosed in the prior art. For example, such arrangements are disclosed in the following U.S. Pat. Nos. 2,394,964; 2,994,433; 3,357,561; 4,487,690; 4,652,321; 4,799,713; 5,234,582; and 5,378,356.

Such drain arrangements of the prior art are burdened by various disadvantages. For example, such prior arrangements often do not provide adequate sealing between the drain arrangement and the structure or building in which it is employed. Other types of prior arrangements employ mechanical means, such as mechanical expansion of an inner tube, to provide sealing between the drain arrangement and the building structure. Such mechanical means often do not provide complete sealing between the drain arrangement and the surrounding structure.

The following patents are also considered to be representative of the prior art in this area: U.S. Pat. Nos. 3,884,809; 4,216,790; 4,460,462; 4,739,524; 4,838,732; 4,943,100; 4,964,180; 4,988,234; and 5,376,264.

To summarize, there is a need in the prior art for provision of a drain arrangement which provides efficient, complete and durable sealing between the new roof membrane, the drain arrangement itself and the existing drain found in the building structure.

OBJECTS AND SUMMARY OF THE INVENTION

The present invention generally relates to a roof drain arrangement and method, and more particularly, to an arrangement and method employed with an existing drain on a roof of a building to provide complete, efficient, and durable sealing between the new roof membrane, the roof drain arrangement and the structure of the building, including the existing drain of the building.

In accordance with the present invention, a roof drain insert is retrofitted to an existing drain pipe (e.g. a 3"–6" drain pipe)mounted to a roof structure of the building. More particularly, the previous roof drain arrangement remains below the surface of new insulation, leaving an exposed drain pipe, and the following components are placed in position in a manner to be described in more detail below: a base plate, ring-shaped sealing membranes, a roofing membrane, and a drain insert having an expandable sealing material pre-applied to its lower outer circumference. The aforementioned drain insert has a flange portion, the underside of which has a pre-applied ring of adhesive mastic material fixed thereto such that, when the insert is in its final position, the adhesive material pre-applied to the underside of the flange is brought into sealing contact with the roofing membrane. Furthermore, once the drain insert is in position within the existing drain, the expandable sealing material pre-applied to the lower outer circumference of the insert expands towards and seals against the existing drain pipe.

Therefore, it is a primary object of the present invention to provide a roof drain arrangement and method which is fast, economical and overcomes the deficiencies of conventional devices and methods.

It is an additional object of the present invention to provide an arrangement and method employed with an existing drain on a roof of a building to provide complete, efficient and durable sealing between the roof drain arrangement, the new roof membrane and the structure of the building.

It is an additional object of the present invention to provide a roof drain arrangement and method wherein a drain insert having an expandable sealing material pre-applied to its outer circumference is employed.

It is an additional object of the present invention to provide a roof drain arrangement and method wherein a drain insert has a flange portion, the underside of which has an adhesive mastic material pre-applied to it.

The above and other objects, and the nature of the invention, will be further understood from the following detailed description, the accompanying drawings and the appended claims.

BRIEF DESCRIPTION OF DRAWINGS

FIGS. 2A and 2B are a top view and a side view in section, respectively, of the base plate employed in the present invention.

FIGS. 3A and 3B are a top view and a side view in section, respectively, of the insert employed in the present invention.

BEST MODE FOR CARRYING OUT THE INVENTION

Figure 1:
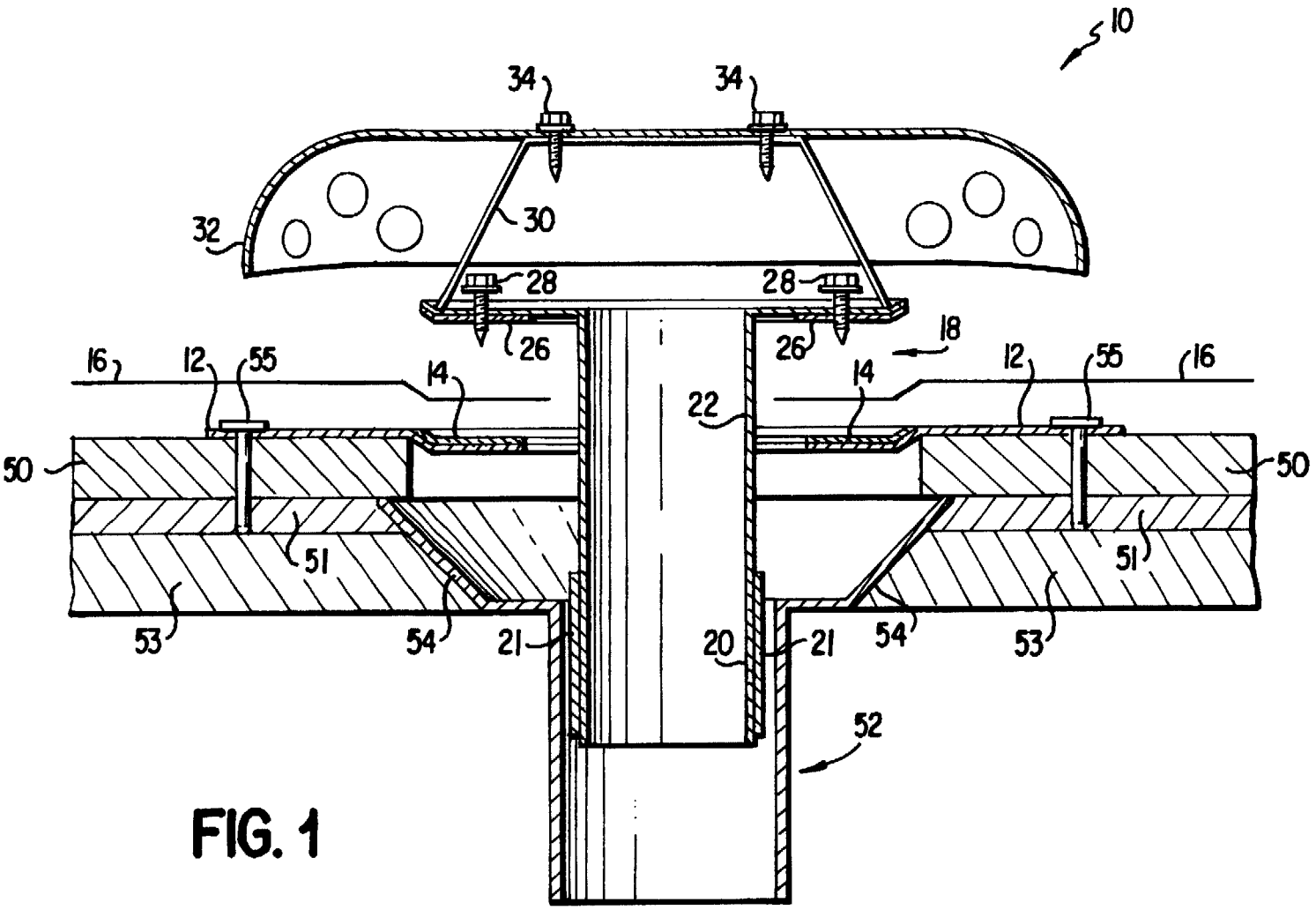
FIG. 1 is a side view in section of the roof drain arrangement of the present invention in position relative to the existing drain and the surrounding roof structure.

The invention will now be described in more detail with reference to the various figures of the drawings.

FIG. 1 is a side view in section of the roof drain arrangement of the present invention. As seen therein, the roof drain arrangement 10 basically comprises the following elements: base plate 12; adhesive ring 14; roofing membrane 16; insert 18 having a bottom portion 20, an upper portion 22 and a flange portion 24; adhesive ring 26; screws 28; frame member 30; strainer 32; and screws 34.

FIGS. 2A and 2B are a top view and a side view in section, respectively, of the base plate 12 of FIG. 1. As seen in FIGS. 2A and 2B, base plate 12 is generally square in shape, although any shape consistent with the disclosure of this invention can be employed. Preferably, base plate 12 is of metal, such as 0.090 aluminum. A center portion **12*a* of base plate 12 is removed, and a further portion 12*b* surrounding the removed portion 12*g*** is recessed, as best seen in FIG. 2B.

Screw holes 13 are provided along the outer edge of base plate 12 so that base plate 12 can be secured to the roof structure 53 (FIG. 1) as the roof drain arrangement is assembled. Other screw holes are produced by using self-drilling, self-tapping screws.

FIGS. 3A and 3B are a top view and a side view in section, respectively, of the insert 18 of FIG. 1. As seen therein, insert 18 has a generally tubular structure including bottom portion 20 and upper portion 22, with a flange portion 24 being provided adjacent to and surrounding upper portion 22. Insert 18 is, preferably, made of metal, such as 0.063 aluminum. Upper portion 22 is, preferably, joined by welding at joint 25 to flange portion 24. Holes 27 are provided adjacent to the outer edge of flange portion 24 so that screws 28 can be used to affix the flange portion 24 to base plate 12 as the roof drain arrangement is assembled.

Further referring to FIGS. 1, 2A, 2B, 3A and 3B, the assembly of the roof drain arrangement of the present invention will now be described. New insulation 50 is installed over the existing roof 51. The existing strainer (not shown) is removed, but the existing drain bowl 54 remains. The previously described base plate 12, having a generally centered, circular cut-out portion **12*a*, is placed on top of the new insulation 50 so that the cut-out portion 12*a* is coaxial with the existing drain 52, and the base plate 12 is screwed into position with standard deck screws 55 inserted into the holes 13. An adhesive ring 14 is pre-applied to the recessed portion 12*b* of base plate 12 so that it surrounds the cut-out portion 12*a* thereof. Roofing membrane 16 is then applied over base plate 12, and is adhered into position by conventional means, such as mastic or other adhesive. A hole is then cut through membrane 16, the hole having a diameter sufficient to accept the tubular portion (bottom portion 20 and upper portion 22) of insert 18**.

Prior to insertion of insert 18 into the hole in membrane 16 and into existing drain 52, an expandable sealing material, such as conventional expandable foam tape 21, is pre-applied to the outer surface of bottom portion 20 of insert 18. Furthermore, an adhesive ring 26 is also pre-applied to the underside of flange portion 24 of insert 18 prior to insertion of insert 18 into the hole in membrane 16 and existing drain 52. Insert 18 is then inserted through the hole in membrane 16 so as to slideably engage the existing drain opening 52.

As the insert 18 is lowered into the hole in membrane 16 and into existing drain 52, adhesive ring 26 comes into contact with roofing membrane 16 which, in turn, is pressed against adhesive ring 14 on recessed portion **12*b* of base plate 12, thereby effecting a first sealing arrangement within the overall roof drain arrangement. Furthermore, once the insert 18 is in its final resting position within existing drain 52, the expandable tape 21 expands toward and seals against the existing drain 52. Screws 28 are employed to secure the flange portion 24 of insert 18 to the base plate 12, with adhesive ring 26, roofing membrane 16, and adhesive ring 14** sandwiched therebetween.

As seen in FIG. 1, insert 18 has a frame member 30 secured (preferably, by welding) to flange portion 24. Once the insert 18 is in place, a strainer 32 is secured to frame member 30 via screws 34.

To summarize, as a result of the present invention, double sealing between the roof drain arrangement 10 and the existing roof structure or deck 53 is achieved. Specifically, sealing is provided adjacent to upper portion 22 of insert 18 via adhesive ring 14, roofing membrane 16 and adhesive ring 26. Moreover, sealing is also provided adjacent to bottom portion 20 of insert 18 via expandable tape 21.

While preferred forms and arrangements have been shown in illustrating the invention, it is to be understood that various changes and modifications can be made without departing from the spirit and scope of this disclosure.

I claim:

1. A roof drain arrangement mounted on an existing drain opening on a roof, said arrangement comprising:

a base plate having a center opening approximately corresponding in size to a cross-section of said existing drain opening, said base plate being positioned directly on said roof so that said center opening of said base plate is in substantial alignment with said cross-section of said existing drain opening, said base plate having an upper surface;

an insert portion approximately corresponding in cross-sectional size to said cross-section of said existing drain opening, said insert portion being inserted into said existing drain opening and having a flange portion adjacent to and surrounding an upper end of said insert portion, said flange portion having a lower surface which rests on said base plate when said insert portion is inserted into said existing drain opening; and sealing means disposed between said lower surface of said flange portion and said upper surface of said base plate for sealing an area therebetween.

2. The arrangement of claim 1, further comprising expandable sealing means disposed on an exterior, lower surface of said insert portion for expanding after insertion of said insert portion into said existing drain opening and for sealing an area between said insert portion and said existing drain opening.

3. The arrangement of claim 1, wherein said sealing means comprises adhesive disposed on said lower surface of said flange portion.

4. The arrangement of claim 1, wherein said sealing means comprises adhesive disposed on an upper surface of said base plate.

5. The arrangement of claim 1, wherein said sealing means comprises a roofing membrane disposed between said lower surface of said flange portion and said upper surface of said base plate.

6. The arrangement of claim 1, further comprising connecting means for connecting said flange portion to said base plate.

7. The arrangement of claim 1, further comprising a frame member disposed on and connected to said flange portion.

8. The arrangement of claim 7, further comprising a strainer mounted on said frame member.

9. The arrangement of claim 1, wherein said base plate has an inner recessed portion and said sealing means is applied to said inner recessed portion.

10. A method for sealing a roof drain arrangement mounted on an existing drain opening on a roof, said method comprising the steps of:

disposing a base plate around a center opening of said existing drain opening;

providing a tubular insert having a flange portion located at an upper portion of said tubular insert;

disposing a sealing material on an upper surface of said base plate; and lowering said tubular insert into said existing drain opening so that said lower surface of said flange portion comes to rest on said sealing material, thereby sealing an area between said lower surface of said flange portion and said upper surface of said base plate.

11. The method of claim 10, further comprising the step of providing an expandable seal between an inner surface of said existing drain opening and an outer surface of said tubular insert.

12. The method of claim 10, further comprising the step, prior to the lowering step, of disposing an adhesive material on said lower surface of said flange portion.

13. The method of claim 10, further comprising the step, prior to the lowering step, of disposing a roofing membrane over said base plate.

14. The method of claim 13, further comprising the step, prior to the lowering step, of cutting a hole in said roofing membrane.

15. The method of claim 14, further comprising the step, prior to the lowering step, of disposing an adhesive material on said lower surface of said flange portion.

16. The method of claim 13, further comprising the step, prior to the lowering step, of disposing an adhesive material on said lower surface of said flange portion.

17. The method of claim 10, wherein said base plate has an inner recessed portion and said sealing material is applied to said inner recessed portion.

* * * * *